US007213808B2

(12) United States Patent
Botschek et al.

(10) Patent No.: US 7,213,808 B2
(45) Date of Patent: May 8, 2007

(54) ENCLOSURE-COLLATING DEVICE, IN PARTICULAR FOR MAIL-PROCESSING INSTALLATIONS

(75) Inventors: Christian Botschek, Rodermark (DE); Martin Sting, Bad Vibel (DE)

(73) Assignee: Pitney Bowes Deutschland GmbH, Heppenhein (DE)

( * ) Notice: Subject to any disclaimer, the term of this patent is extended or adjusted under 35 U.S.C. 154(b) by 98 days.

(21) Appl. No.: 10/925,403

(22) Filed: Aug. 25, 2004

(65) Prior Publication Data

US 2005/0072126 A1 Apr. 7, 2005

(30) Foreign Application Priority Data

Sep. 1, 2003 (DE) ..... 103 40 220

(51) Int. Cl.
*B65H 5/02* (2006.01)

(52) U.S. Cl. ..... 271/225; 271/266; 271/270; 271/184; 271/189; 271/202

(58) Field of Classification Search ..... 271/245, 271/182, 225, 9.11, 9.12, 9.13, 10.01, 184, 271/198, 242, 276; 198/443, 463.4, 452; 270/52.16, 52.21, 52.22

See application file for complete search history.

(56) References Cited

U.S. PATENT DOCUMENTS

| | | | | |
|---|---|---|---|---|
| 4,257,587 | A * | 3/1981 | Smith | 271/236 |
| 5,413,326 | A * | 5/1995 | Wright | 271/225 |
| 5,503,386 | A * | 4/1996 | Straessler et al. | 271/225 |
| 5,775,690 | A * | 7/1998 | Quesnel et al. | 271/242 |
| 5,967,510 | A * | 10/1999 | Ono et al. | 271/196 |
| 6,168,154 | B1 * | 1/2001 | Asahara et al. | 271/245 |
| 6,619,650 | B2 * | 9/2003 | Gysin et al. | 271/10.01 |
| 2002/0105131 | A1 | 8/2002 | Koelle | |

FOREIGN PATENT DOCUMENTS

| | | |
|---|---|---|
| DE | 10220908 C1 | 6/2003 |
| EP | 1160186 A2 | 5/2001 |

* cited by examiner

*Primary Examiner*—Patrick Mackey
*Assistant Examiner*—Jeremy R Severson
(74) *Attorney, Agent, or Firm*—Michael J. Cummings; Steven J. Shapiro; Angelo N. Chaclas

(57) ABSTRACT

In an enclosure-collating device, in particular for mail-processing installations, a shorter dimensioning of the enclosure-conveying compartments on a collating path in the direction of the enclosure conveying on said collating path is achieved in that enclosures are fed into the enclosure-conveying compartments obliquely with a movement component in the conveying direction of the enclosure-conveying arrangement by an oblique conveying device of a transfer device serving to feed the enclosures into the enclosure-conveying compartments.

3 Claims, 3 Drawing Sheets

ENCLOSURE-COLLATING DEVICE, IN PARTICULAR FOR MAIL-PROCESSING INSTALLATIONS

BACKGROUND OF THE INVENTION

The invention pertains to an enclosure-collating device, in particular for mail-processing installations, having an enclosure-forwarding device, which exhibits endless, driven, circulating conveying chains or conveying belts that are provided with conveying fingers that project beyond the surface of a collating path in the region of the top chain or belt strands and, in pairs, define enclosure-conveying compartments located in front of them as seen in the conveying direction. In the case of known enclosure-collating devices, enclosure-feeding devices are located alongside the collating path over the course of said collating path, and serve for introducing individual documents into the enclosure-conveying compartments that are being conveyed past.

This known design of enclosure-collating devices provides that the enclosure-conveying arrangement is driven intermittently in such a way that conveying-finger pairs that define an enclosure-conveying compartment located in front of them are stopped immediately before the introduction region of an enclosure-feeding device and then the enclosure-feeding device is started in order to insert or dispense an enclosure into an enclosure-conveying compartment perpendicularly to the conveying direction of the enclosure-conveying arrangement.

If one wants to drive the enclosure-conveying arrangement continuously in order to increase the operating speed of the enclosure-collating devices, then, in combination with such a continuously driven enclosure-conveying device, special forms of enclosure-feeding devices are required that discharge or insert enclosures into the enclosure-conveying compartments from above.

If conventional enclosure-feeding devices of the type briefly described above, which feed enclosures into the conveying compartments from the side and perpendicular to the conveying direction of the enclosure-conveying arrangement, are to be used in combination with continuously driven enclosure-conveying arrangements, then these conveying compartments must be dimensioned very large in the conveying direction of the enclosure-conveying arrangement, which requires a large spacing of the enclosure-conveying compartments along the enclosure-conveying direction, and the advantage of a continuous driving of the enclosure-conveying arrangement in the sense of an increase in operating speed is largely negated. This is due to the fact that in addition to the format of the enclosure to be inserted, an enclosure-conveying compartment that is to be filled during its continuous movement must be made larger by at least one segment, in the conveying direction of the enclosure-conveying arrangement, which corresponds to the time of the complete insertion of an enclosure by the enclosure-feeding device transversely to the conveying direction of the enclosure-conveying arrangement, multiplied by the conveying speed of the enclosure-conveying arrangement.

SUMMARY OF THE INVENTION

Accordingly, the invention is to solve the problem of developing an enclosure-collating device of the type described briefly at the beginning in such a way that a high operating speed of the enclosure-conveying arrangement is attained, in particular, when being driven continuously. The problem on which the invention is based also includes reducing the spacing of the enclosure-conveying compartments in the conveying direction and increasing the cycle speed of the enclosure-feeding devices located on the course of the collating path, and of additional processing stations, for example, in a mail-processing installation.

The invention also pertains to enclosure-collating devices with intermittent drive of the enclosure-conveying arrangement, since through implementation of the inventive design, the possibility is provided of, for example, having a specific insertion compartment in front of the conveying finger pair that defines it restarted early after it has been stopped at the start of the introduction region of an enclosure-feeding device, after, as a result of the action of the oblique conveying device, the trailing edge of an enclosure specified for the relevant enclosure-conveying compartment leads the conveying fingers that later grasp this edge. Thus, even during cyclical operation of the enclosure-conveying arrangement, a shortening of the cycle times is achieved, which is also accompanied by less abrupt deceleration and acceleration of the controlled parts as well.

Embodiments are explained in more detail below with references to the following drawings.

DETAILED DESCRIPTION OF THE INVENTION

Figure 1:
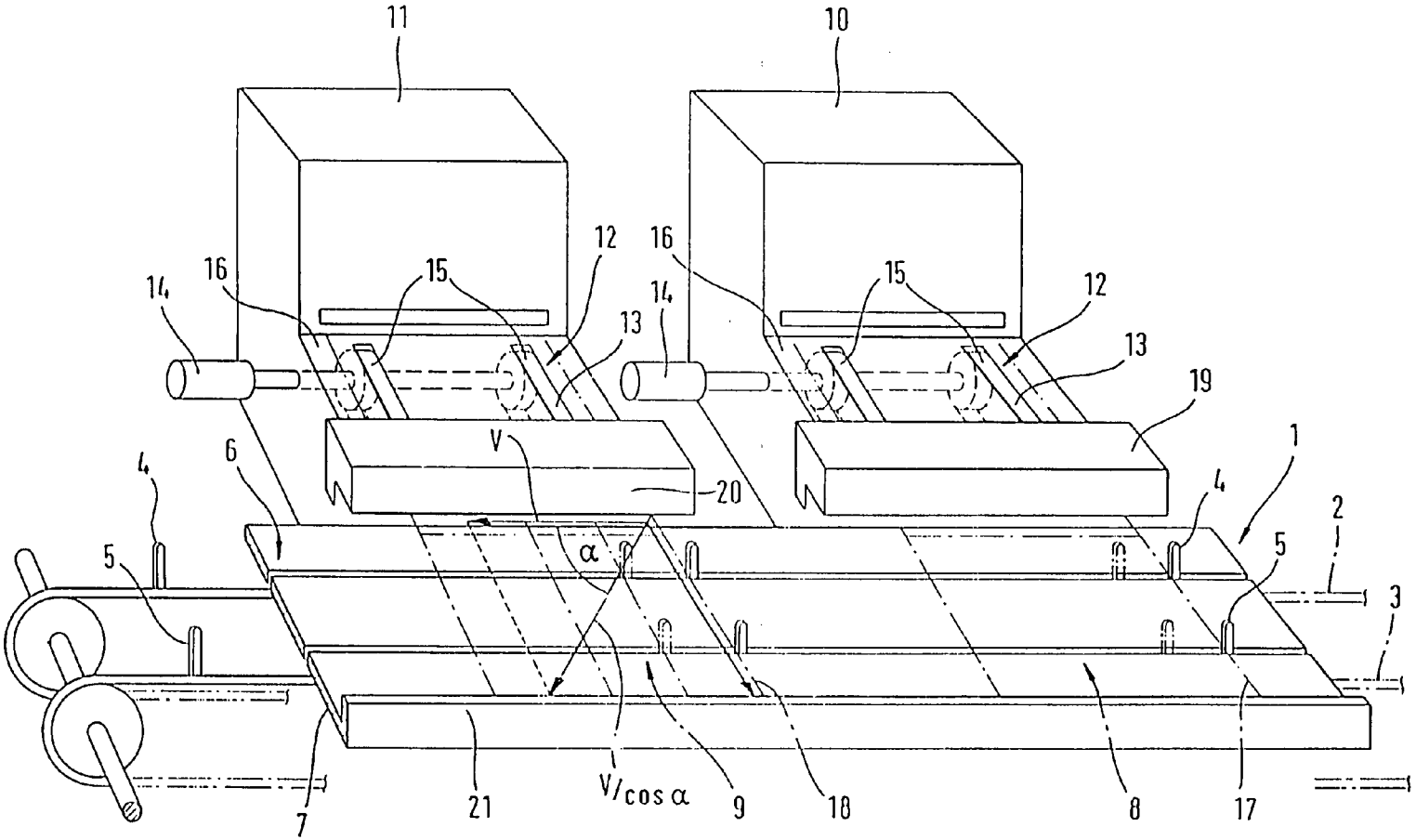
FIG. 1 is a schematic perspective view of an enclosure-collating device of the previously described type.

FIG. 1 shows in a perspective, highly schematicized representation, a detail of an enclosure-collating device of the type being suggested here. It contains an enclosure-conveying arrangement 1 with endless, according to the present embodiment, continuously driven, circulating conveying chains or conveying belts 2, 3 that are provided with conveying fingers 4, 5. The conveying chains or conveying belts are guided by chain wheels or pulleys at the beginning and end of the enclosure-conveying arrangement, as is shown only schematically in FIG. 1, whereby a chain-wheel pair or a pulley pair is coupled with a suitable driving means. In the region of the top strands of the conveying chains or conveying belts 2, 3, the conveying fingers 4, 5 project above the surface 6 of a collating path 7 and, in pairs, define enclosure-conveying compartments 8 and 9 that are located in front of them as seen in the conveying direction. Enclosure-conveying segments or compartments of the functional type of the compartments 8 and 9 can also be defined without the use of conveying fingers.

Located alongside the collating path 7 are enclosure-feeding devices 10, 11, which contain transfer devices 12 for feeding individual enclosures into the enclosure-conveying compartments 8 and 9. In turn, each of the transfer devices 12 contains an intermediate conveying device 13 by means of which individual enclosures from a supply of enclosures or from a stream of separate enclosures are conveyed in the direction of the enclosure-conveying arrangement essentially perpendicularly to the conveying direction of the latter.

The intermediate conveying devices 13 are in the form of endless conveyor belts or conveying belts 15, which are put into circulation by driving means 14 and the top strands of which project through cutouts slightly above the surface of transfer tables 16 and which have the task of frictionally connecting these top strands from underneath to enclosures that have been applied through an unshown means and moving such enclosures forward in the direction perpendicular to the conveying direction of the enclosure-conveying arrangement.

It is significant that the frictional forces between the enclosures laid on the transfer tables 16 on the one hand and the top strands of the conveying belts or conveyor belts 15 on the other are dimensioned in such a way that next, after placing an enclosure from a supply of enclosures or from a stream of separate enclosures onto the transfer table 16, a reliable conveying perpendicular to the conveying direction of the enclosure-conveying arrangement takes place, but then, when an enclosure has been completely conveyed onto the transfer table 16 and is lying on same, a further conveying of the relevant enclosure with a movement component transverse to the conveying direction of the intermediate conveying device 13, i.e., transverse to the running direction of the conveyor belts or conveying belts 15, is possible.

To adjust the frictional forces between the undersides of enclosures forwarded by the enclosure-feeding devices 10 and 11 on the one hand and the top sides or outsides of the conveyor belts or conveying belts 15 on the other, pressing means that are familiar to the person skilled in the art can be provided in the region of the transfer devices 12, although they are not shown in the drawing. Such pressing means have, for example, the form of brush strips or of plates mounted at a suitable distance above the transfer tables 16, or else of rolling balls held and supported in cages or cage arrangements that lie with limited pressing force on the fed enclosures.

Once an enclosure in the enclosure-feeding device 10, 11 has been completely laid onto or conveyed forward onto a transfer table 16 by means of the intermediate conveying device 13, the relevant enclosure is brought to a standstill on its conveying path perpendicular to the conveying direction of the enclosure-conveying arrangement by a stopping means, not shown in FIG. 1, and is only released for further conveying when an enclosure-conveying compartment 8, 9 that is able to receive it moves past the relevant enclosure-feeding device 10, 11.

Once the trailing end, as seen in the conveying direction of the enclosure-conveying arrangement, of an enclosure-conveying compartment 8, 9 is essentially flush with the trailing edge, relative to the mentioned conveying direction, of an enclosure lying on the transfer table 16, as is indicated by the dot-dash lines 17 and 18 in FIG. 1, an oblique conveying device 19 and 20 of the transfer device 10 and 11 grips a particular enclosure lying on the transfer table 16 and conveys this enclosure from the conveying end position of the intermediate conveying device 13 in a translatory, essentially linear movement at an angle $\alpha$ to the conveying direction of the envelope-conveying device 1 obliquely into the associated enclosure compartment 8 and 9, whereby as a result, the trailing edge, as seen in the conveying direction of the enclosure-conveying arrangement, of the obliquely conveyed enclosure moves away in front of the rear delimitations 17, 18 of the enclosure-conveying compartments as a result of the translatory, oblique conveying until the oblique conveying devices 19, 20 have released the particular enclosure and a side edge of the relevant enclosure has pushed against a guide flange or guide straightedge 21 of the collating path 1.

The oblique conveying of enclosures into the enclosure compartments 8, 9 in an essentially linear movement as described and explained with the aid of FIG. 1 has the advantage over a translatory circular movement that adjusting the coordinated control of the particular conveying driving means and the adjusting of the conveying phases to the formats of the enclosures to be inserted and to the particular drive speeds are simple and concise.

It should also be mentioned with reference to FIG. 1, that the oblique conveying devices 19, 20 perform an oblique conveying of the enclosures delivered by the intermediate conveying devices 13 linearly at a speed such that after the obliquely conveyed enclosures came free of the oblique conveying devices 19, 20, the enclosures are moved ahead up to the stop flange or the stop straightedge 21 while finally completely filling the enclosure-conveying compartments 8 and 9, so that in the embodiment shown in FIG. 1, the oblique conveying devices 19, 20 are always located completely outside the conveying route of the enclosures along the enclosure-conveying arrangement 1.

However, if all that is involved in the case of the oblique conveying devices 19, 20 is a system that grips the top of an enclosure that is to be inserted into an enclosure-conveying compartment 8, 9, then it is not necessary for the oblique conveying devices 19, 20 to be located completely outside the path of the enclosures on the enclosure-conveying device 1. For example, the oblique conveying devices 19, 20 can then involve obliquely conveying friction roller sets that act only above the enclosure surfaces, or circulating belts that are provided with vacuum openings and do not require a support mechanism below the level of the transfer tables 16 or the collating path of the enclosure-conveying arrangement.

For implementation of the movement sequences previously described in connection with FIG. 1 in the region of the intermediate conveying devices 13 and the oblique conveying devices 19, 20, as well as in the region of the enclosure-conveying arrangement 1, a control unit is provided which is not shown in FIG. 1, but which controls a driving means of the oblique conveying devices 19, 20 in dependence on the drive speed of a driving means of the enclosure-conveying arrangement 1 in such a way that the vector of the speed of an enclosure as a result of being driven by the oblique conveying devices 19, 20 has a component in the direction of the collating path that is essentially equal to the vector of the drive speed of the conveying fingers 4, 5. For example, if the magnitude of the drive speed of the conveying fingers 4, 5 is equal to V, then the magnitude of the drive speed of the oblique conveying devices 19, 20 is $V/\cos\alpha$, as is made clear in FIG. 1 by the corresponding arrows.

The thoughts that were discussed above show the usefulness of an oblique feeding of enclosures into the enclosure-conveying compartments 8, 9 during continuous driving of the conveying fingers 4, 5, whereby the individual enclosure-conveying compartments 8, 9 can have less spacing in the conveying direction of the enclosure-conveying arrangement 1 than the corresponding known devices do. However, as has already been indicated earlier, oblique feeding of enclosures by the transfer devices 10, 11 is advantageous even with intermittent driving of the conveying fingers of the collating path, since with oblique feeding of enclosures the feeding phase can overlap chronologically with the movement phases of the conveying fingers 4, 5, as a result of which the operating procedure is accelerated and in turn the dimension of the enclosure-conveying compartments in the conveying direction can be reduced.

In addition, when compared with a feeding of enclosures into the conveying compartments from above, the feeding of enclosures into the enclosure-conveying compartments 8, 9 during their continuous movement past the transfer devices 10, 11 has the significant advantage of good accessibility to the collating path to clear malfunctions.

Figure 2:
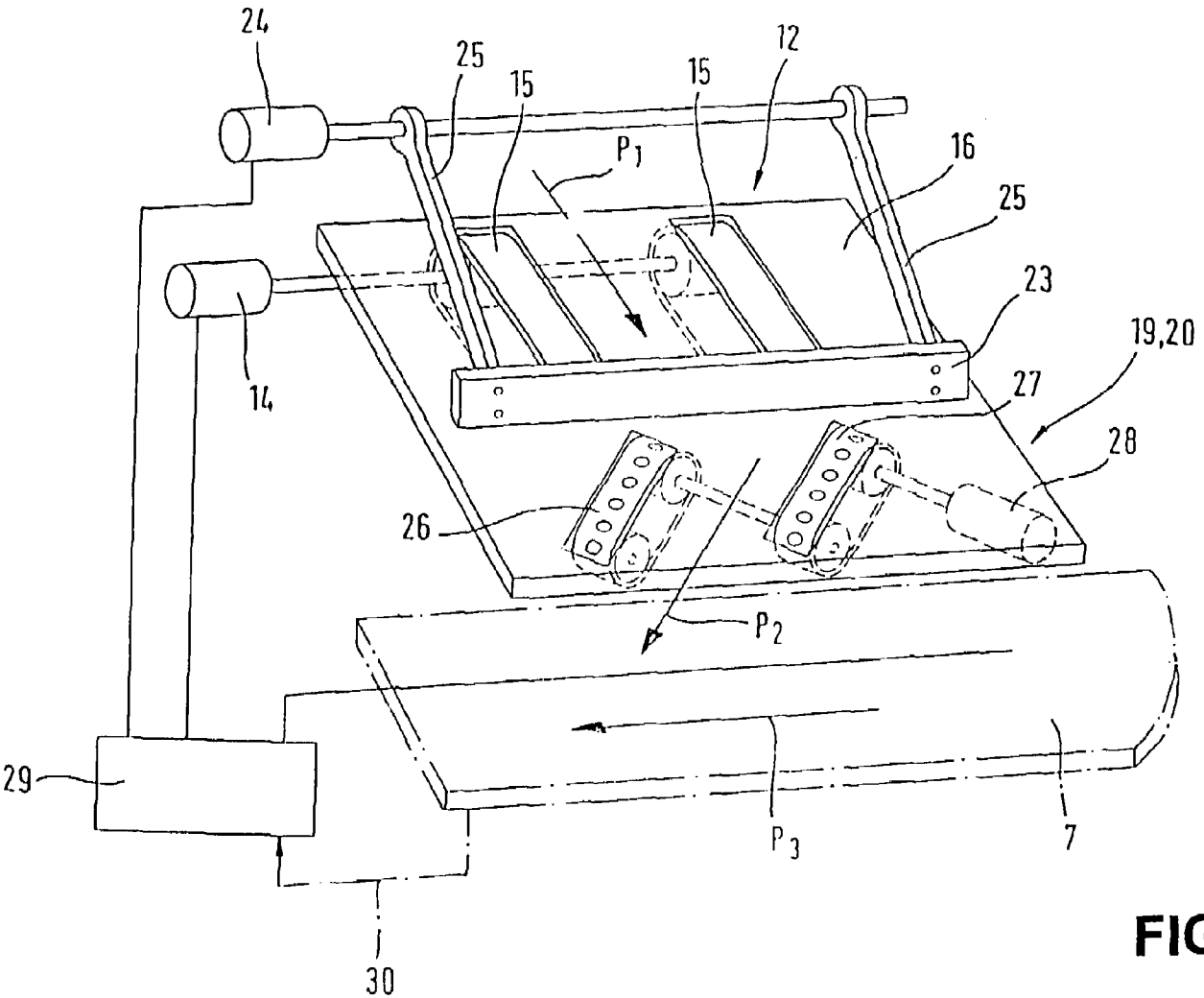
FIG. 2 is a schematic perspective representation of an intermediate conveying device and an oblique conveying device of the transfer device of an enclosure-collating device according to FIG. 1.

FIG. 2 shows in schematic and perspective representation an embodiment of an intermediate conveying device and an oblique conveying device for a transfer device 10, 11. Parts corresponding to those of the embodiment according to FIG. 1 have been provided with the same reference symbols in FIG. 2.

In turn, the intermediate conveying device 13 has the form of conveyor belts or conveying belts 15 which are guided parallel to one another, with the top strands reaching above cutouts in a transfer table 16, and which are put into circulation by a driving means 14 and which convey by means of frictional forces enclosures from, for example, a supply of enclosures or from a stream of separate enclosures that are placed on the transfer table 16, in the direction towards a stopping straightedge 23. Once the leading edge, as seen in the conveying direction of the intermediate conveying device 13, reaches the stopping straightedge 23, the relevant enclosure is then stopped, whereby, however, the conveyor belts or conveying belts 15 of the intermediate conveying device 13 remain in circulation and run frictionally underneath the stopped enclosure.

If the stopping straightedge 23 is now pivoted upward on connecting rods 25 by a driving means 24, the conveyor belts or conveying belts 15, frictionally on the underside of an enclosure lying on the transfer table 16, grip said enclosure and continue to move it so that the leading edge, as seen in the conveying direction of the intermediate conveying device 13, of the enclosure is grasped by two perforated belts 26 and 27, which are put into circulation synchronously and are directed above vacuum chambers, and which now draw in the enclosure that is aligned in the conveying direction in accordance with the direction of arrow P1, grasp it, and convey it obliquely in a translatory movement in the direction of arrow P2, without the friction between the underside of the enclosure and the conveying belts or conveyor belts 15 changing the alignment of the relevant enclosure, since for this purpose, the frictional forces between the enclosure and the conveyor belts 15 is inadequate versus the strong clamping of the underside of the enclosure by the circulating vacuum conveyor belts 26, 27.

A driving means for the vacuum conveyor belts 26, 27, which is designated 28, the driving means 14 that moves the conveyor belts or conveying belts 15, and the driving means 24 for pivoting the stopping straightedge 23 up and down, are connected to a control unit 29, which also receives detector signals from the collating path 7, which is indicated by the dot-dash line at 30, whereby the detector signals report the particular operating positions of the conveying fingers 4, 5 to the control unit 29. With continuously circulating conveyor belts or conveying belts 15 and continuously circulating vacuum conveyor belts 26, 27 in dependence on the particular setting of the conveying fingers 4, 5 of the collating path 7, this causes at the appropriate time a feeding by the oblique conveying device 19, 20 of an enclosure held ready on the transfer table 16 into an enclosure compartment for further conveying of the enclosure in the direction of arrow P3.

In a modification of the embodiment just outlined above, the conveyor belts or conveying belts 15 and the vacuum conveyor belts 26, 27 can also be driven intermittently in a suitable chronological overlapping and matched to a work cycle of the stopping straightedge 23.

Figure 3:
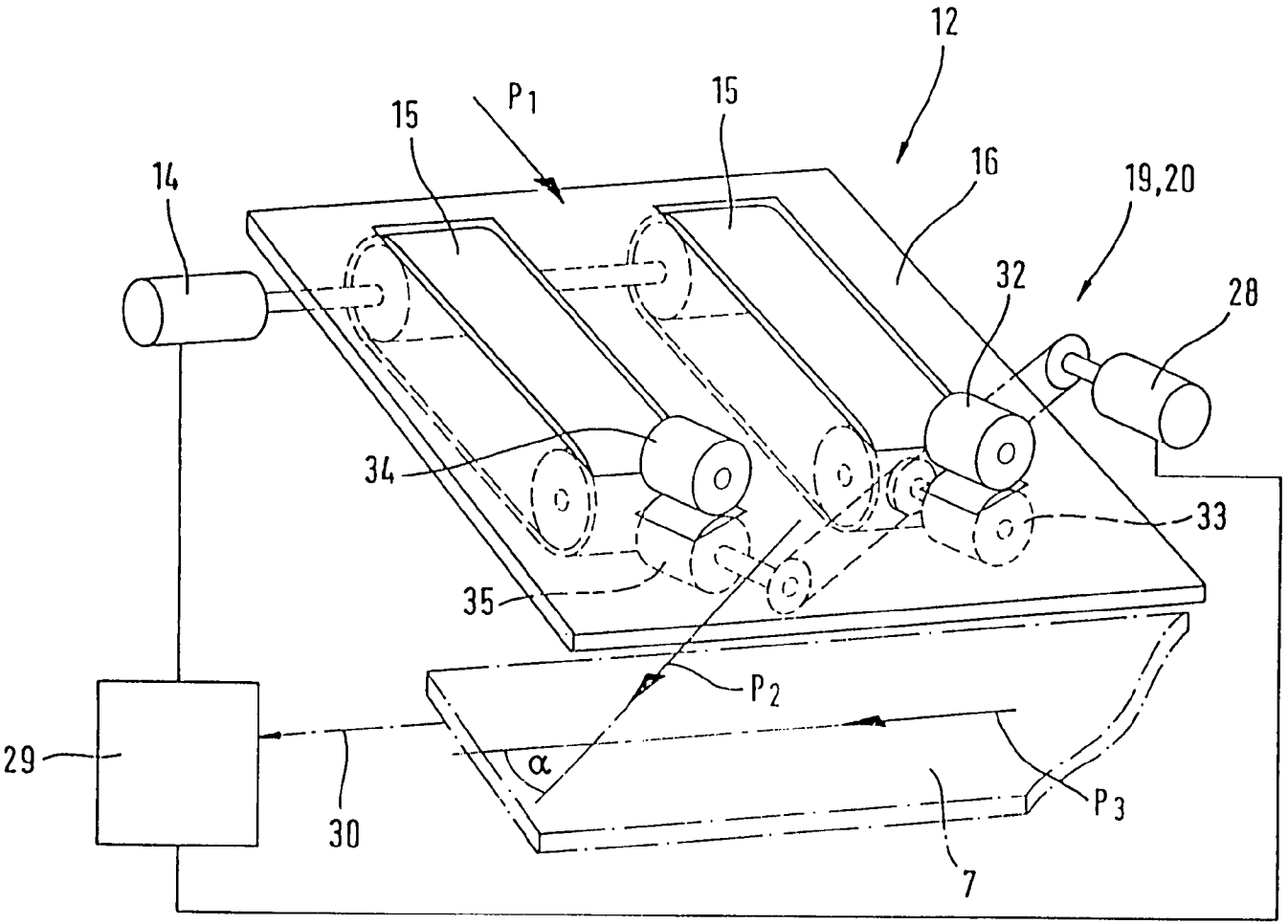
FIG. 3 is a schematic perspective representation of another embodiment of the intermediate conveying device and the oblique conveying device of the transfer device for an enclosure-collating device according to FIG. 1.

The embodiment of the transfer device 12 according to FIG. 3 differs from the one according to FIG. 2 primarily in that here the use of a stopping straightedge 23 to stop an enclosure in the region of the intermediate conveying device for further conveying by the oblique conveying device 19, 20 is dispensed with.

In this embodiment, the oblique conveying devices 19, 20 have the form of roller pairs 32 and 33 plus 34 and 35, whereby each of the lower rollers 33 and 35 is placed under the transfer table 16 and projects above the level of the transfer table through cutouts in the transfer table in the flat regions at the end of the conveyor belts or conveying belts 15 of the intermediate conveying device. The lower rollers 33 and 35 are driven synchronously intermittently by a driving means 28. The spring-loaded upper rollers 32 and 34, which are prestressed against the lower rollers 33 and 35 by prestressing means, not shown, are track rollers. All of the rollers 32 to 35 possess drive shafts or bearing spindles having an orientation relative to the drive shafts or bearing spindles of the rollers for the conveyor belts or conveying belts 15 is $(90°+\alpha)$, so that the conveying direction according to arrow P2 in turn takes on an angle $\alpha$ with respect to the conveying direction of the collating path according to arrow P3.

During operation, enclosures from a supply of enclosures or from a stream of separate enclosures are placed on the transfer table 16 and are conveyed by the intermediate conveying device's conveyor belts or conveying belts 15, which are kept in continuous circulation while maintaining friction tightness, which allows movement of an enclosure with a movement component transverse to the conveying direction of the intermediate conveying device according to arrow P1, against the roller pairs 32 and 33 plus 34 and 35, which at first are still not driven and are standing still, and which form with the conveying nip between them a stop for the enclosures conveyed by the conveyor belts or conveying belts 15, by means of which the leading edge, as seen from the conveying direction according to arrow P1, of an enclosure is aligned parallel to the conveying direction according to arrow P3 of the collating path, or remains aligned if an aligned conveying has already taken place.

If the driving means 28 for the roller pairs 32 and 33 plus 34 and 35 is now put into operation, then the leading edge, as seen from the conveying direction according to arrow P1, of an enclosure is grasped by the conveying nip between roller pairs 32 and 33 plus 34 and 35 and the enclosure is fed in a translatory movement essentially linearly obliquely in the direction of arrow P2 into an enclosure compartment of the collating path 7, whereby the same operations take place relative to the position or the movement of the conveying finger pairs 4, 5 of the collating path, as they were discussed previously with reference to FIG. 1.

Provided in the embodiment according to FIG. 3 as well is a control unit 29, by means of which the switching on and switching off of the driving means 28 is controlled, for example, in dependence on position report signals from the line 30 in accordance with the particular instantaneous position of the enclosure-conveying compartments. An intermittent switching on of the driving means 14 for the conveyor belts or conveying belts 15 of the intermediate conveying device can also be carried out by the control unit 29 in accordance with a modified operational mode.

It should also be noted that in accordance with an embodiment of the transfer device that is not shown, the intermediate conveying device can also be equipped with vacuum conveyor belts similar to the conveyor belts 26 and 27 of the embodiment according to FIG. 2 instead of the conveyor belts or conveying belts 15 that grasp the enclosure undersides frictionally. In this case, through suitable adjustment of the vacuum at least in the region of the end of these vacuum conveyor belts, care is taken that the oblique conveying device can accept enclosures from the intermediate conveying device and with a movement component transverse to the conveying direction of the intermediate conveying device, can remove them from same in a translatory, essentially linear movement.

What is claimed is:

1. An enclosure-collating device, in particular for mall-processing installations, having:

an enclosure-conveying arrangement having driven conveying fingers farming enclosure-conveying compartments on a collating path; and at least one enclosure-feeding device located alongside the collating path and containing a transfer device for introducing individual documents into the enclosure-conveying compartments;

wherein the transfer device contains an intermediate conveying device by means of which individual enclosures from a supply of enclosures or a stream of separate enclosures are conveyed in the direction of the enclosure-conveying arrangement to a conveying end position;

wherein the conveying end position of the intermediate conveying device is followed by an oblique conveying device which grips enclosures located in the conveying end position of the intermediate conveying device and conveys them with translatory movement, at an angle (90°-$\alpha$) to the conveying directions of intermediate conveying device into an enclosure-conveying compartment of the enclosure-conveying arrangement;

wherein a control unit controls a drive of the oblique conveying device in dependence on the drive speed of the drive or the enclosure-conveying arrangement such that a vector of the speed of an enclosure on account of being driven by the oblique conveying device has a component in the direction of the collating path which is essentially equal to a vector of the drive speed of the conveying fingers;

wherein the intermediate conveying device is driven continuously;

wherein the intermediate conveying device conveys the enclosures against nips of intermittently driven pairs of rollers of the oblique conveying device, said roller nips, while at a standstill, serving as a stop and wherein the control unit controls the enclosure-collating device such that the enclosure-conveying arrangement is driven intermittently, and the oblique conveying device is switched on intermittently.

2. An enclosure-collating device, in particular for mall-processing installations, having:

an enclosure-conveying arrangement having driven conveying fingers forming enclosure-conveying compartments on a collating path; and at least one enclosure-feeding device located alongside the collating path and containing a transfer device for introducing individual documents into the enclosure-conveying compartments;

wherein the transfer device contains an intermediate conveying device by means of which individual enclosures from a supply of enclosures or a stream of separate enclosures are conveyed in the direction of the enclosure-conveying arrangement to a conveying end position;

wherein the conveying end position of the intermediate conveying device is followed by an oblique conveying device which grips enclosures located in the conveying end position of the intermediate conveying device and conveys them with translatory movement, at an angle (90°-$\alpha$) to the conveying directions of the intermediate conveying device into an enclosure-conveying compartment of the enclosure-conveying arrangement;

wherein a control unit controls a drive of the oblique conveying device in dependence on the drive speed of the drive or the enclosure-conveying arrangement such that a vector of the speed of an enclosure on account of being driven by the oblique conveying device has a component in the direction of the collating path which is essentially equal to a vector of the drive speed of the conveying fingers;

wherein the oblique conveying device contains circulating perforated vacuum-type conveying belts which are guided over vacuum chambers and run in the conveying direction of the oblique conveying device; and wherein the control unit controls the enclosure-collating device such that the enclosure-conveying arrangement is driven intermittently, and the oblique conveying device is switched on intermittently.

3. An enclosure-collating device according to any one of claims 1 or 2, wherein the operation of conveying an enclosure by the oblique conveying device is controlled at such a speed that an enclosure moves on all the way into an enclosure-conveying compartment following the conveying operation by the oblique conveying device.

* * * * *